US006129597A

United States Patent [19]

Gresko

[11] Patent Number: 6,129,597

[45] Date of Patent: Oct. 10, 2000

[54] BYPASS SYSTEM FOR CATV SIGNAL TAP

[75] Inventor: Richard Gresko, Huntingdon Valley, Pa.

[73] Assignee: General Instrument Corporation, Hatboro, Pa.

[21] Appl. No.: 09/022,706

[22] Filed: Feb. 12, 1998

[51] Int. Cl.[7] ..... H01R 13/24

[52] U.S. Cl. ..... 439/824; 439/583; 439/277

[58] Field of Search ..... 439/824, 825, 439/320–2, 583, 585, 277

[56] References Cited

U.S. PATENT DOCUMENTS

| | | | |
|---|---|---|---|
| 3,132,289 | 5/1964 | Russo . | |
| 3,134,931 | 5/1964 | Kobryner . | |
| 3,171,909 | 3/1965 | Foskett . | |
| 3,617,811 | 11/1971 | McVoy . | |
| 3,643,209 | 2/1972 | Coston . | |
| 3,764,956 | 10/1973 | Norden . | |
| 3,768,063 | 10/1973 | Coffman . | |
| 3,881,160 | 4/1975 | Ross . | |
| 3,895,318 | 7/1975 | Ross . | |
| 3,914,564 | 10/1975 | Reed et al. . | |
| 3,962,610 | 6/1976 | Reed et al. . | |
| 4,388,670 | 6/1983 | Billhartz . | |
| 4,660,921 | 4/1987 | Hauver . | |
| 4,755,776 | 7/1988 | Preschutti . | |
| 4,825,021 | 4/1989 | Pauza . | |
| 4,934,954 | 6/1990 | Fransson et al. | 439/131 |
| 5,571,028 | 11/1996 | Szegda | 439/322 |
| 5,648,745 | 7/1997 | Spriester et al. . | |

*Primary Examiner*—Lincoln Donovan
*Attorney, Agent, or Firm*—Volpe and Koenig, P.C.

[57] ABSTRACT

A system for bypassing a signal tap that includes a pair of plug ports which are aligned with a pair of contact terminals that connect the conductors to the tap. The system generally comprises a pair of contact plugs adapted to be inserted into the plug ports and a jumper. Each plug includes a generally hollow body and a plunger. The hollow body is substantially open at a first end and terminates in a head surface, having an aperture therethrough, at a second end. Each plunger is moveable between a non-contact position and a contact position. The jumper includes at least two pins which are conductively interconnected and adapted to be inserted into the apertures to allow a signal flowing through the tap to flow through the jumper.

33 Claims, 8 Drawing Sheets

BYPASS SYSTEM FOR CATV SIGNAL TAP

BACKGROUND OF THE INVENTION

1. Field of the Invention

The present invention relates to cable television transmission components. More particularly, the invention relates to a bypass system which prevents interruption of the cable signal to downstream subscribers during servicing of a cable television tap.

2. Description of Related Art

Cable television (CATV) services are provided to subscribers through transmission networks that include taps, splitters, amplifiers and other equipment that distribute CATV service and ensure that the CATV signal quality is maintained. In particular, taps reside along the. network to provide access outlets for localized subscribers. CATV network and service as used herein refers to all systems involving the transmission of television signals from the headend over a transmission medium, such as fiber optic cable or coaxial cable.

FIG. 1 is a block diagram of a CATV network 5. The transmission line 34 provides cable signals from the headend 32 to subscribers 38, 39 at remote locations. The subscribers 38, 39 receive signals through taps 36, 37 placed along the transmission line 34. The CATV signals are typically routed into the tap and through a printed circuit board attached to the tap cover which splits the signal and allows each tap 36, 37 to typically provide a connection to four or more subscribers.

Referring to FIG. 2, a prior art CATV multiple tap 15 is shown. The multiple tap 15 generally includes a tap cover 10, a printed circuit board 14, a pair of terminal housings 40 and a main housing 26. The tap cover 10 is provided with a plurality of tap outlets 12, each of which provides CATV service to a different subscriber. The printed circuit board 14 is rigidly attached to the inside surface of the cover 10 and includes a pair of signal receptors 22, 23. The signal receptors 22, 23 allow the signal to flow through the printed circuit board 14 and to be split among the subscribers fed from the tap outlets 12. The signal also passes through the tap 15 to a downstream tap 37. A detailed explanation of the function of the printed circuit board 14, which is well known to those skilled in the art, is outside the scope of the present invention. A metal braid 11 surrounds the periphery of the printed circuit board 14 at the junction between the cover 10 and the main housing 26. The metal braid 11 provides an EMI/RFI trap for the printed circuit board 14.

The main housing 26 includes threaded signal ports 24, 25 at opposing ends. The input signal port 24 is adapted to receive a signal input via a coaxial cable and a signal impact connector 50. The output signal port 25 receives a signal output connector 51 for outputting the received signal to the downstream CATV network. The internal conductor 52, 53 of each coaxial cable 50, 51 is connected inside the tap 15 at a terminal housing 40. A threaded plug port 27 is provided adjacent to each signal port 24, 25 to allow plugs 28 to be removed. Exposed terminal screws 46 aligned with the ports 27 are tightened onto the conductors 52, 53 to fix each to a contact terminal 42 positioned in the respective terminal housing 40 (see FIG. 5). The components of the terminal housing 40 are shown in greater detail in FIG. 4. Upon engagement of the cover 10, the receptors 22, 23 on the printed circuit board 14 engage the contact terminals 42 to complete the circuit.

Referring to FIG. 3, the uninterrupted signal path 16 for the CATV tap 15 is illustrated. When the cover 10 is installed, the signal, shown as line 16, originates from the signal input connector 50. The signal input conductor 52 contacts the contact terminal 42 within the first terminal housing 40 and the signal flows through the contact terminal 42 to the first signal receptor 22 on the printed circuit board 14. The signal then flows through the printed circuit board 14 (and thus to each individual tap 12) and to the second signal receptor 23. The second signal receptor 23 is coupled to the second contact terminal 42 within the other terminal housing 40 which contacts the conductor 53 within signal output connector 51.

Periodically, the taps 36, 37 require servicing due to malfunctioning of the tap 36, 37 or to connect or disconnect subscribers 38, 39. However, when the cover 10 is removed for servicing the tap 15, the printed circuit board 14 is also removed and the signal path is open-circuited since the signal receptors 22, 23 no longer are connected to the contact terminals 42. As a result, removal of the cover results in interruption of the cable signal over the transmission line 34 to subscribers downstream from that tap. For example, returning to FIG. 1, servicing of the tap 36 not only results in interruption of service to the subscribers 38 who are fed from that tap 36, but also subscribers 39 who access the CATV network 5 through the downstream tap 37. Because of the increasing reliance upon the CATV system for life-saving and other data critical applications, even a momentary signal interruption is undesirable. However, there is often no provision for maintaining uninterrupted service to downstream subscribers when the cover of the tap is removed for servicing.

In prior art systems, bypassing is generally accomplished by removing both of the plugs 28 and utilizing a jumper to bridge between the two contact terminals 42. The jumper generally includes two prongs which are conductively interconnected. Each prong is placed into one of the open plug ports 27 and contacted with a respective terminal screw 46 to reroute the signal flow around the tap 15. However, it is often difficult and time consuming to remove the plugs. Additionally, removal of the plugs exposes the internal components of the tap to environmental contamination.

Accordingly, it is an object of the invention to provide a bypass system which provides uninterrupted service to downstream subscribers during removal of the tap cover for servicing.

It is a further object of the invention to provide a cost efficient bypass which can be retrofitted to existing devices.

SUMMARY OF THE INVENTION

Figure 1:
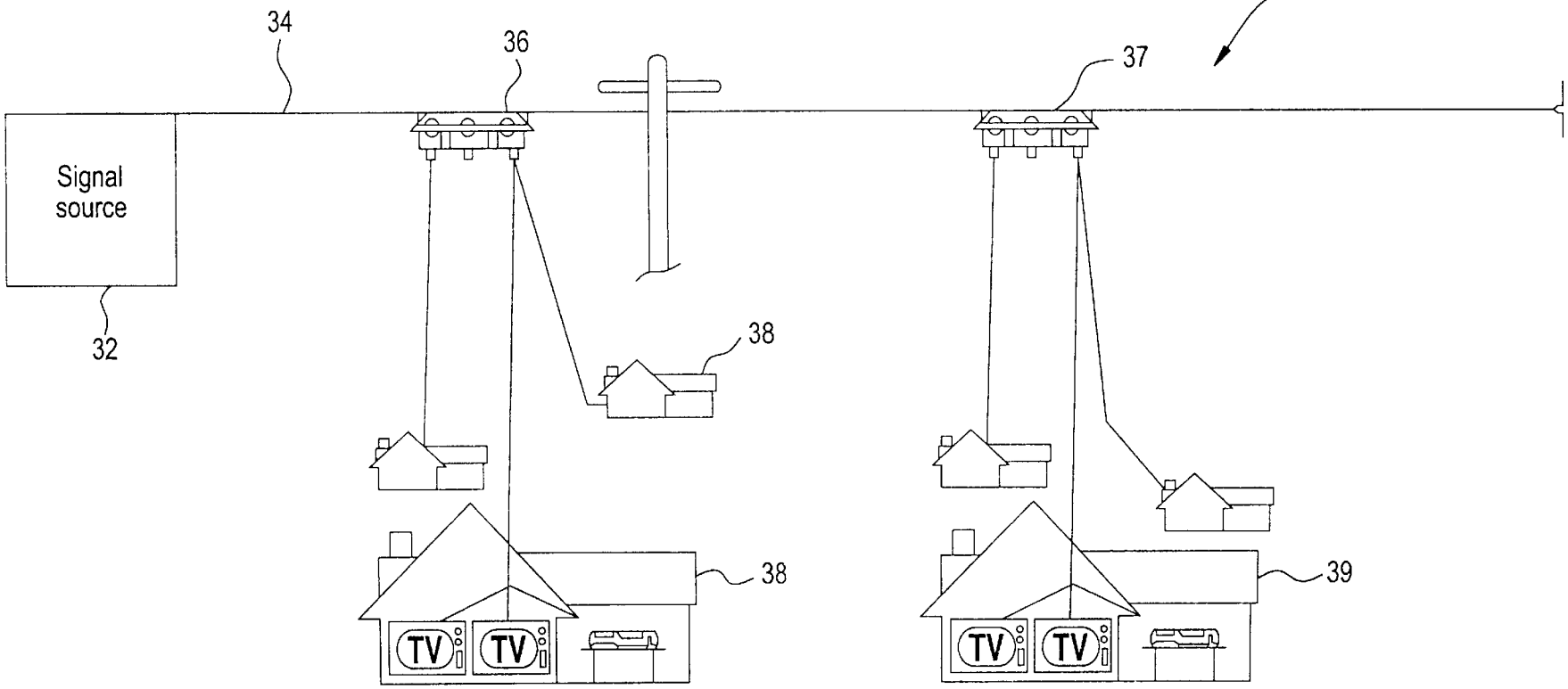
FIG. 1 is an overall system block diagram of a typical cable television system.
Figure 2:
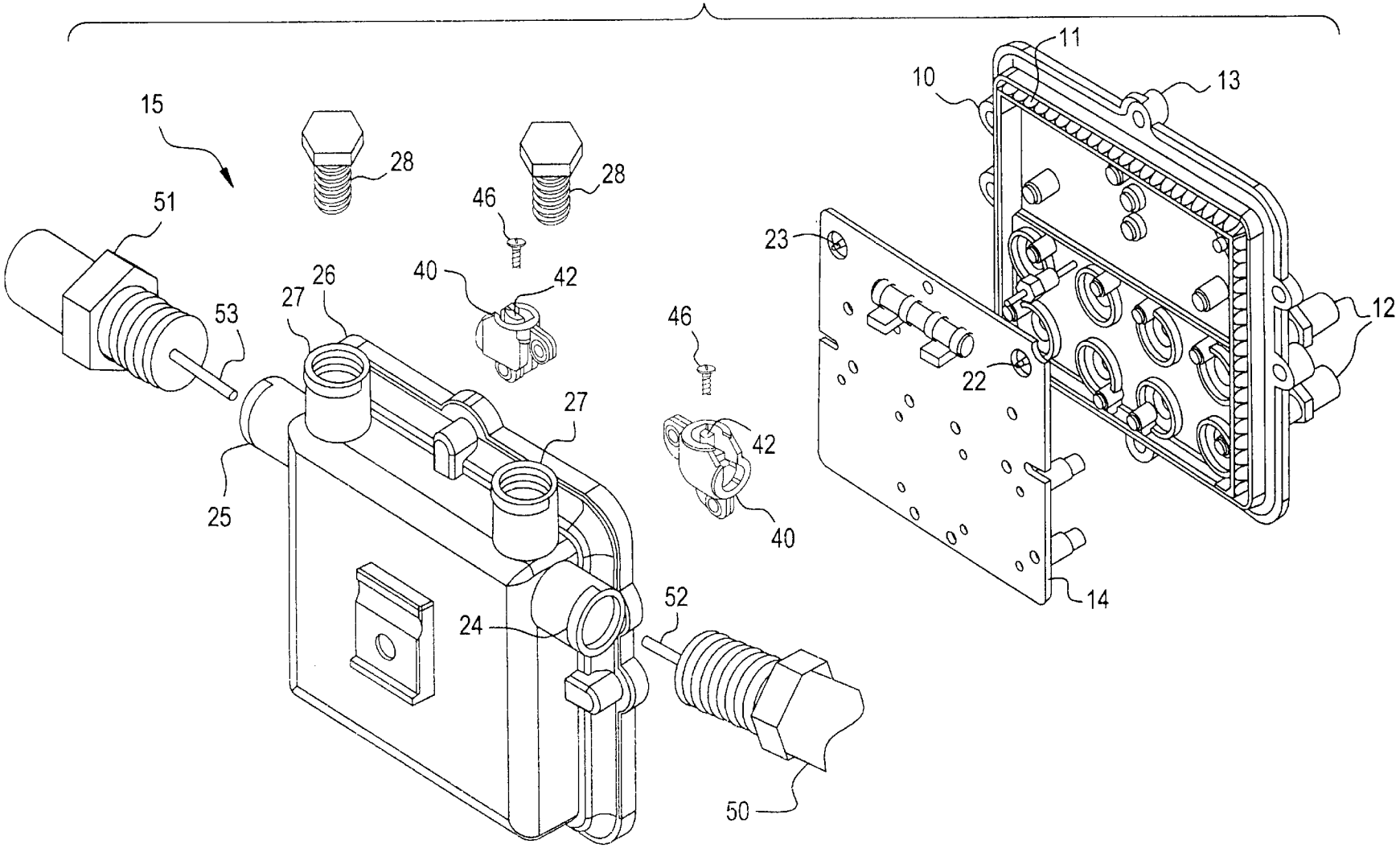
FIG.2 PRIOR ART
FIG. 2 is a perspective view of a prior art cable tap.
Figure 3:
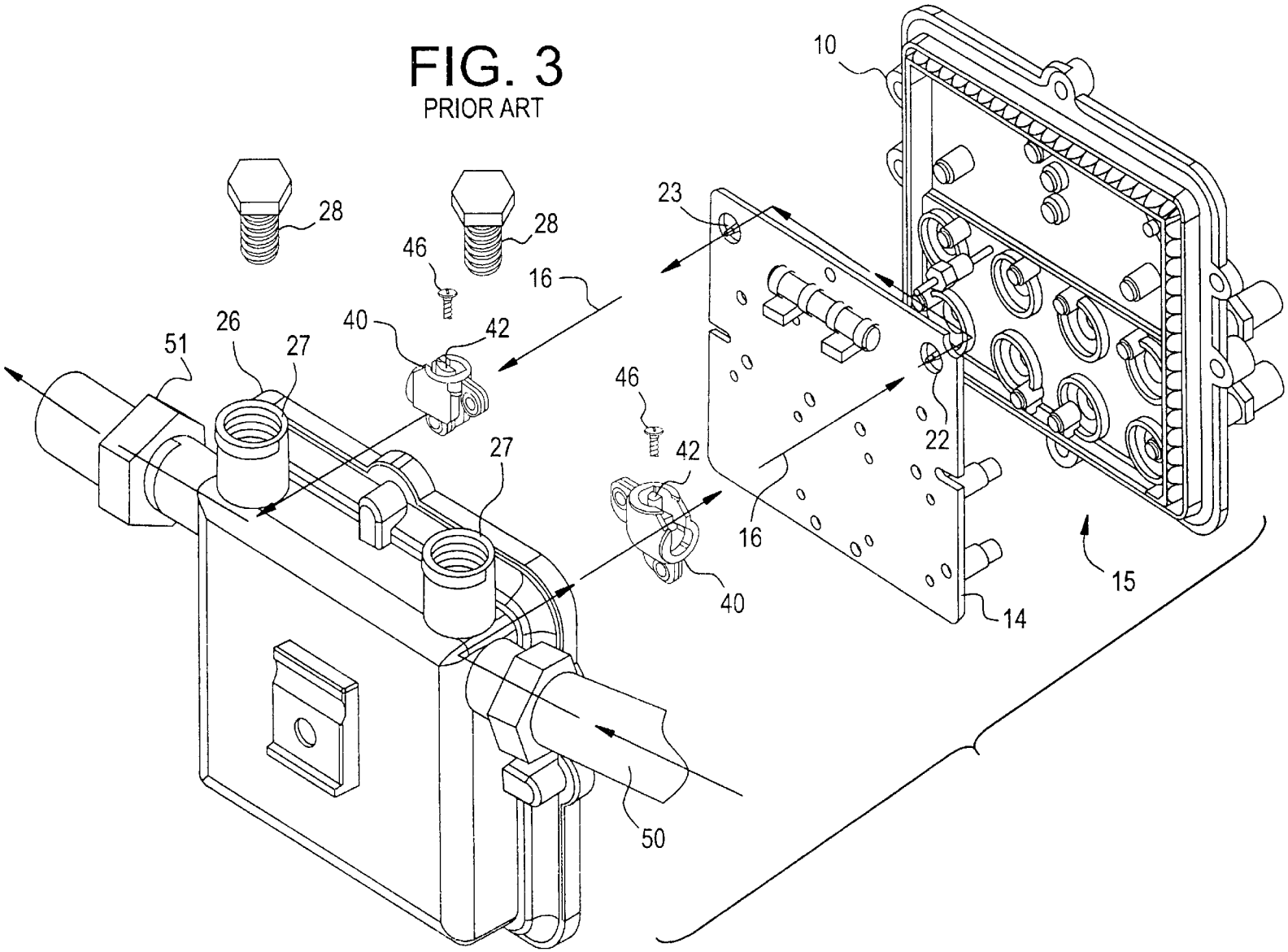
FIG. 3 PRIOR ART
FIG. 3 is a perspective view of the signal path through the prior art cable tap.
Figure 4:
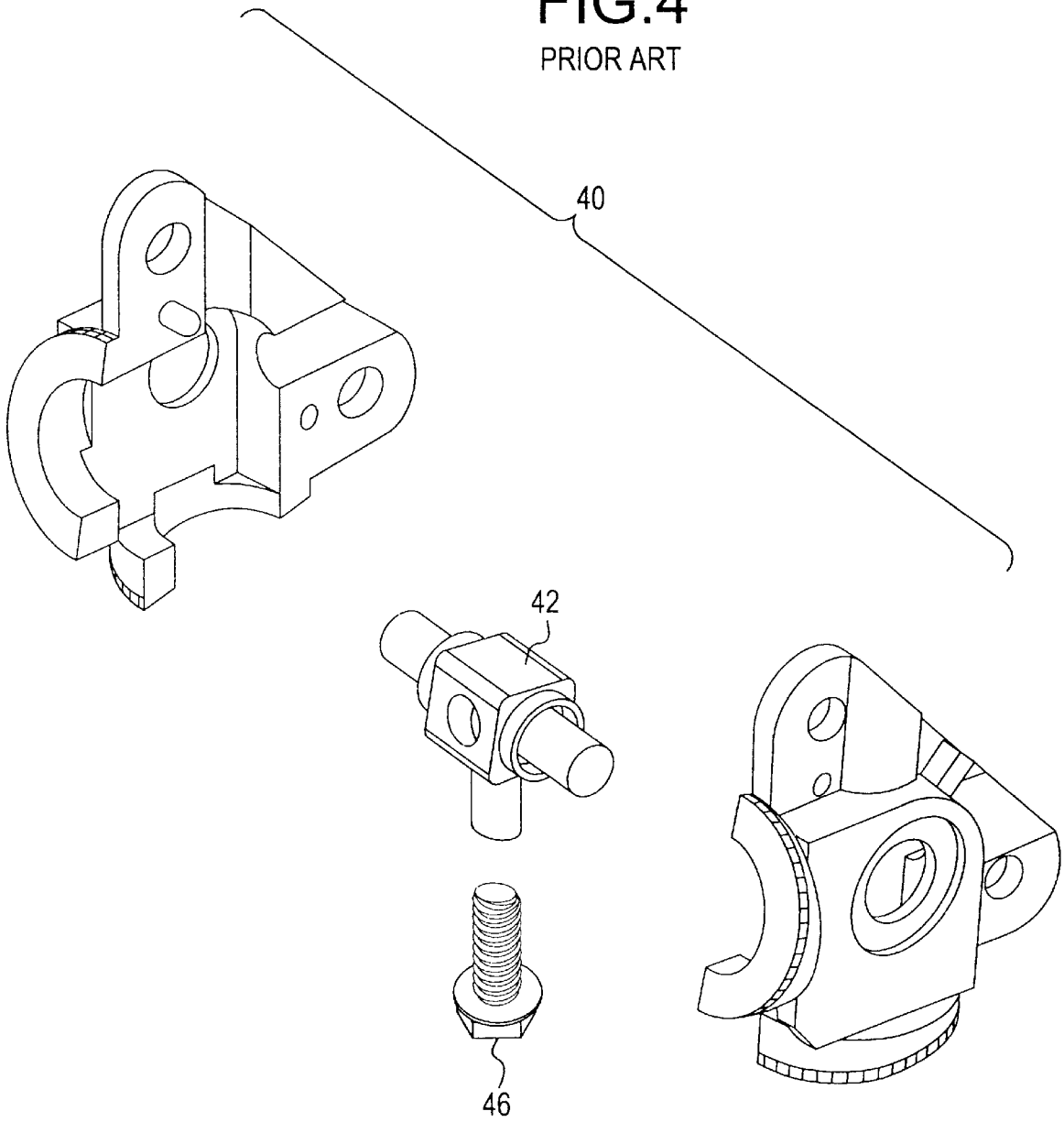
FIG.4 PRIOR ART
FIG. 4 is a perspective view of a disassembled terminal housing.
Figure 5:
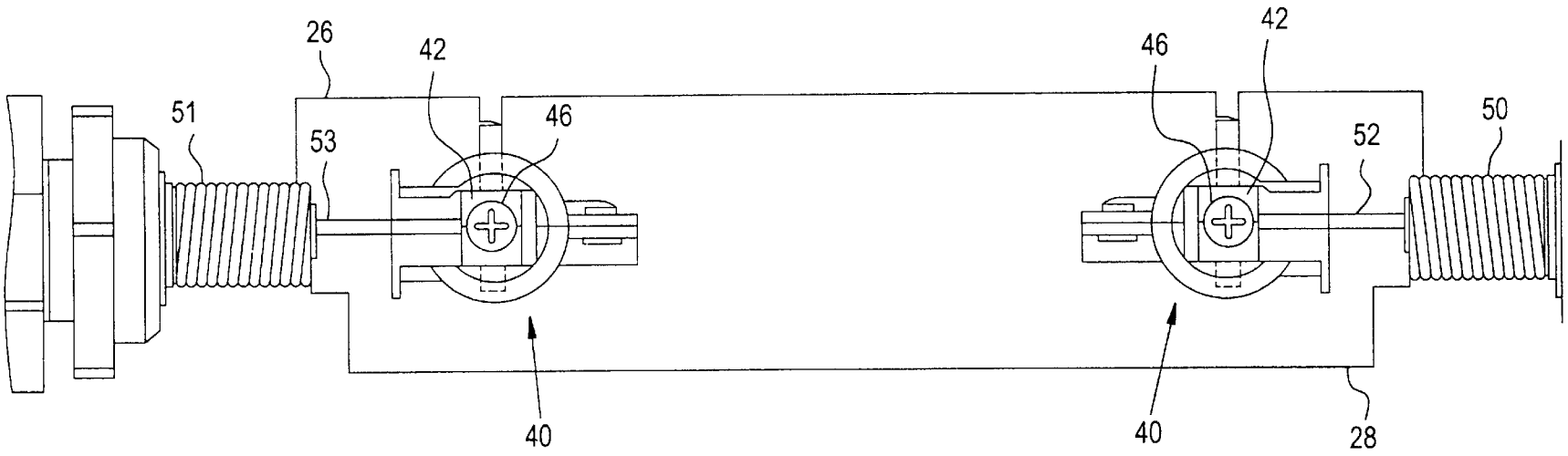
FIG. 5 PRIOR ART
FIG. 5 is a plan view of the cables being connected in the tap.

The present invention relates to a system or kit for bypassing a signal tap. The tap includes a pair of plug ports which are aligned with a pair of contact terminals that connect the conductors to the tap. The system generally comprises a pair of contact plugs adapted to be inserted into the plug ports and a jumper. Each plug includes a hollow body and a plunger. The hollow body is open at a first end and terminates in a head surface, having an aperture therethrough, at a second end. Each plunger is positioned in the hollow body in alignment with the aperture. Each plunger is moveable between a non-contact position and a position where it extends from the open end and is in conductive contact with the terminal contact. The jumper includes at least two pins which are conductively interconnected and adapted to be aligned with the apertures. To allow a signal flowing through the tap to flow through the jumper, the pins are inserted into the apertures and move the plungers to the contact positions.

DETAILED DESCRIPTION OF THE PREFERRED EMBODIMENT

The preferred embodiment will be described with reference to drawing figures where the numerals represent like elements throughout.

As shown in FIGS. 6–9, the present bypass system generally comprises a contact plug 120 and a modified jumper 160. The preferred bypass system 100 allows the tap 15 to be bypassed without removing the plugs 120. The contacting plugs 120, in conjunction with the modified jumper 160, reduce the potential risk of environmental contamination in the tap 15 during bypassing.

Figure 6:
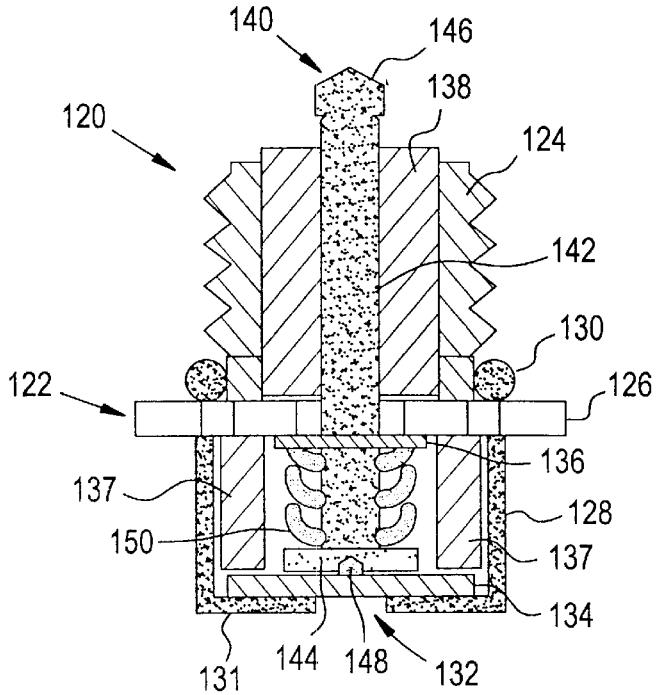
FIG. 6 is a section view of the preferred connection plug.

The preferred contact plug 120 is shown in FIG. 6. The contact plug 120 includes a hollow bolt body 122. The hollow body 122 has a configuration similar to prior art plugs 28 and generally comprises a threaded portion 124, a washer portion 126 and a head 128. The threaded portion 124 is configured to be threaded into the tap plug ports 27. A washer 130 is positioned over the threaded portion 124 and provides an environmental barrier between the plug port 27 and the washer 126. The head 128 has the same general configuration as a standard bolt with the exception of an aperture 132 extending through the terminal surface 131 of the head 128. The aperture 132 is preferably centered in the terminal surface 131 (see FIG. 7).

A gland 134 is provided on the inside of the terminal surface 131 to completely seal off the aperture 132. The gland 134 will be punctured upon penetration of a jumper pin as will be described hereinafter. Alternatively, the gland 134 may be provided with an initial passage (not shown) to allow penetration. A plunger 140 is positioned in the hollow body 122, preferably coaxial with the aperture 132. The plunger 140 includes a main shaft 142 which is preferably slightly greater in length than the hollow body 122. The main shaft 142 terminates at one end in a collar 144 and at the other end in a configured tip 146. The shaft 142 extends through an aperture in a retaining collar 136 positioned in the bolt head 128 adjacent to the washer 126. The retaining collar 136 is preferably made from a non-conductive material and maintains the plunger 140 in its axial alignment. The retaining collar 136 also provides a seal between the head 128 and threaded portion 124 to prevent contamination from entering the tap 15 upon insertion of a jumper pin 170 into the bolt head 128.

The plunger is movable between a retracted position where the collar 144 is adjacent to the gland 134 and a contact position adjacent the returning collar 136. The plunger 140 is urged toward the retracted position by a spring 150 positioned between the retaining collar 136 and the plunger collar 144. The plunger collar 144 includes a detent 148 for receiving a jumper pin, as will be described hereinafter.

Insulation 137, 138 is provided about the plunger 140 in the head 128 and threaded portion 124. The insulation 137, 138 helps prevent grounding of the plunger 140 against the internal surfaces of the contact plug 120.

Figure 8:
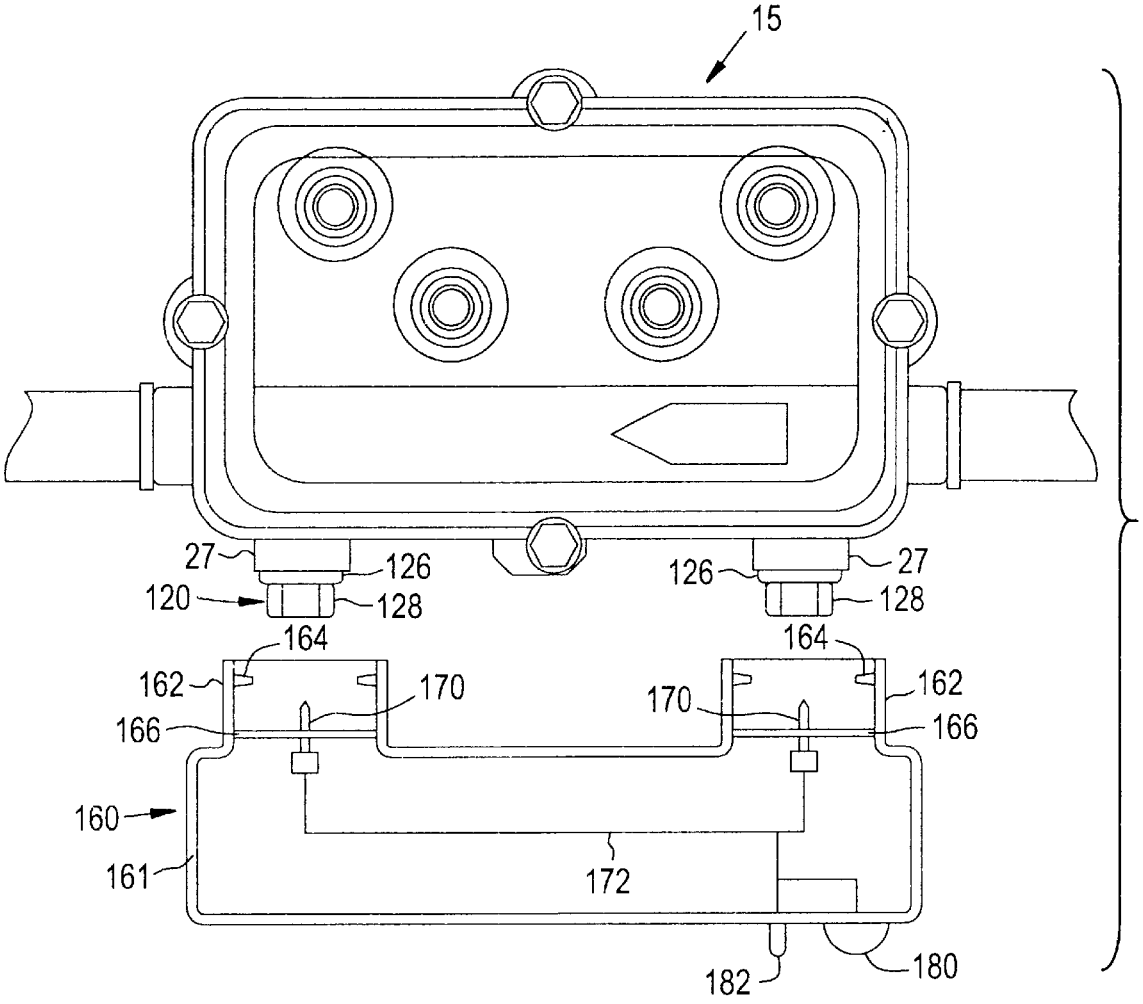
FIG. 8 is a section view of the preferred jumper, with the sectioned jumper aligned with a tap.
Figure 7:
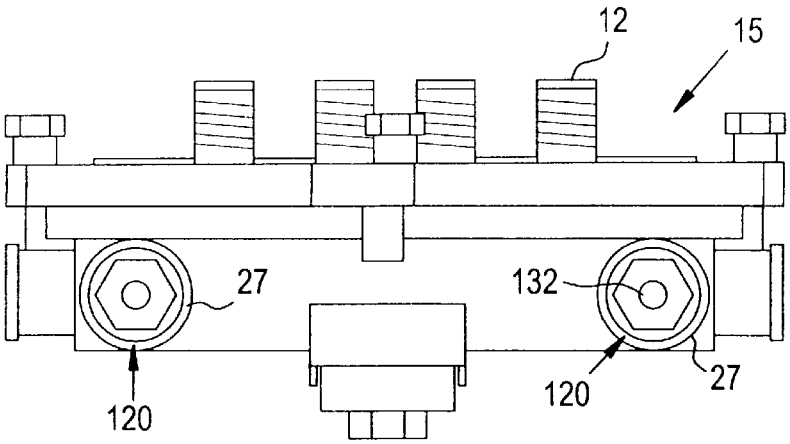
FIG. 7 is a bottom plan view of a tap with the connection plugs inserted therein.

The preferred modified jumper 160 is shown in FIG. 8. The jumper 160 includes an insulated body 161 with a pair of connection ports 162 extending therefrom. A pair of partitions 166 generally close the body 161 from the open ports 162. A conductive jumper pin 170 extends through each partition 166 into a respective open port 162 and preferably terminates prior to the sealing ring 164. The pair of jumper pins 170 are conductively interconnected inside of the jumper body 161 by conductor means 172.

The connection ports 162 are spaced to align with the plug ports 27 on the tap 15. Each connection port 162 is sized to extend over a respective plug port 27 and includes a sealing ring 164 which contacts the exterior surface of the plug port 27 as the jumper 160 is moved into engagement with the tap 15. The sealing ring 164 provides a seal against contamination and also maintains proper alignment of the jumper pin 170 as it is inserted into the contact plug 120. Each pin 170 is centered in the extension 162 whereby it is in alignment with the plug aperture 132 upon engagement with the tap 15. Since each pin 170 is set back in the port 162 and maintained in alignment by the sealing ring 164, the risk of the pin 170 contacting the surface of the a plug 120 is reduced.

In operation, the contact plugs 120 are screwed into the plug ports 27. The contact plugs 120 can be provided to new taps 15 and can also be placed in existing taps 15 without disrupting signal flow. Since retrofitting only requires removal of the old plugs 28 and insertion of the contact plugs 120, signal flow is not disturbed during retrofitting of existing taps 15. Since each plunger 140 is maintained in its retracted position, it does not contact the terminal screws 46 and the signal flow through the tap 15 is essentially unaffected when plugs 120 are retrofitted.

When it is necessary to bypass the tap 15, the modified jumper connection ports 162 are aligned with the respective tap plug ports 27. The jumper 160 is then engaged with the tap 15 with the sealing rings 164 contacting the plug ports 27 and maintaining proper alignment during engagement. As the jumper 160 engages the tap 15, each jumper pin 170 penetrates the gland 134 and mates with a respective plunger detent 148. In the preferred embodiment, the jumper pin 170 punctures the gland 134 as it penetrates. In the alternate embodiment described above, the jumper pin 170 penetrates through the small passage provided in the gland 134.

Figure 9:
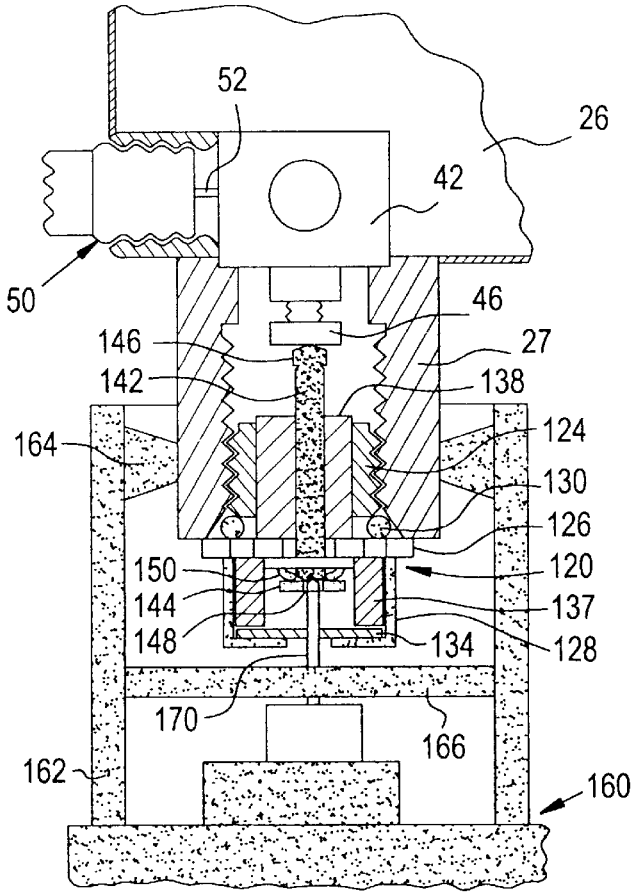
FIG. 9 is a section view of the jumper in engagement with a connection plug of the present invention.

As shown in FIG. 9, each jumper pin 170 pushes a respective plunger 140 towards its contact position. As it moves toward the contact position, the plunger tip 146 extends beyond the plug 120 and contacts the terminal screw 46. The signal is then able to flow from the incoming conductor 52 through the terminal screw 46, through the plunger 140, and through the jumper 160 to the other terminal screw and the outgoing conductor 53 (not shown). The tap cover 10 can be removed without interrupting downstream signal flows.

Once the tap cover 10 is replaced, the jumper 160 can be removed. In the preferred gland 134 embodiment, the jumper pin 170 leaves a small hole in the gland 134 and in the alternate embodiment, the pin 170 exits the provided passage. In any event, the gland 134 is preferably made from a resilient material such that the gland is substantially closed upon removal of the jumper pin 170.

An LED indicator 180, internally connected to the conductor means 172, may be provided on the jumper 160 to indicate when the signal is properly flowing through the jumper 160. Additionally, the LED indicator 180 may also be configured to provide a voltage reading upon activation of button 182. This allows the jumper 160 to not only be used as a bypass, but also as a trouble shooting tool.

While it is preferred to use the modified jumper 160 to provide an efficient, safer bypass, it will be understood that any jumper can be inserted into the contact plugs 120 to bypass the tap 15.

Figure 10:
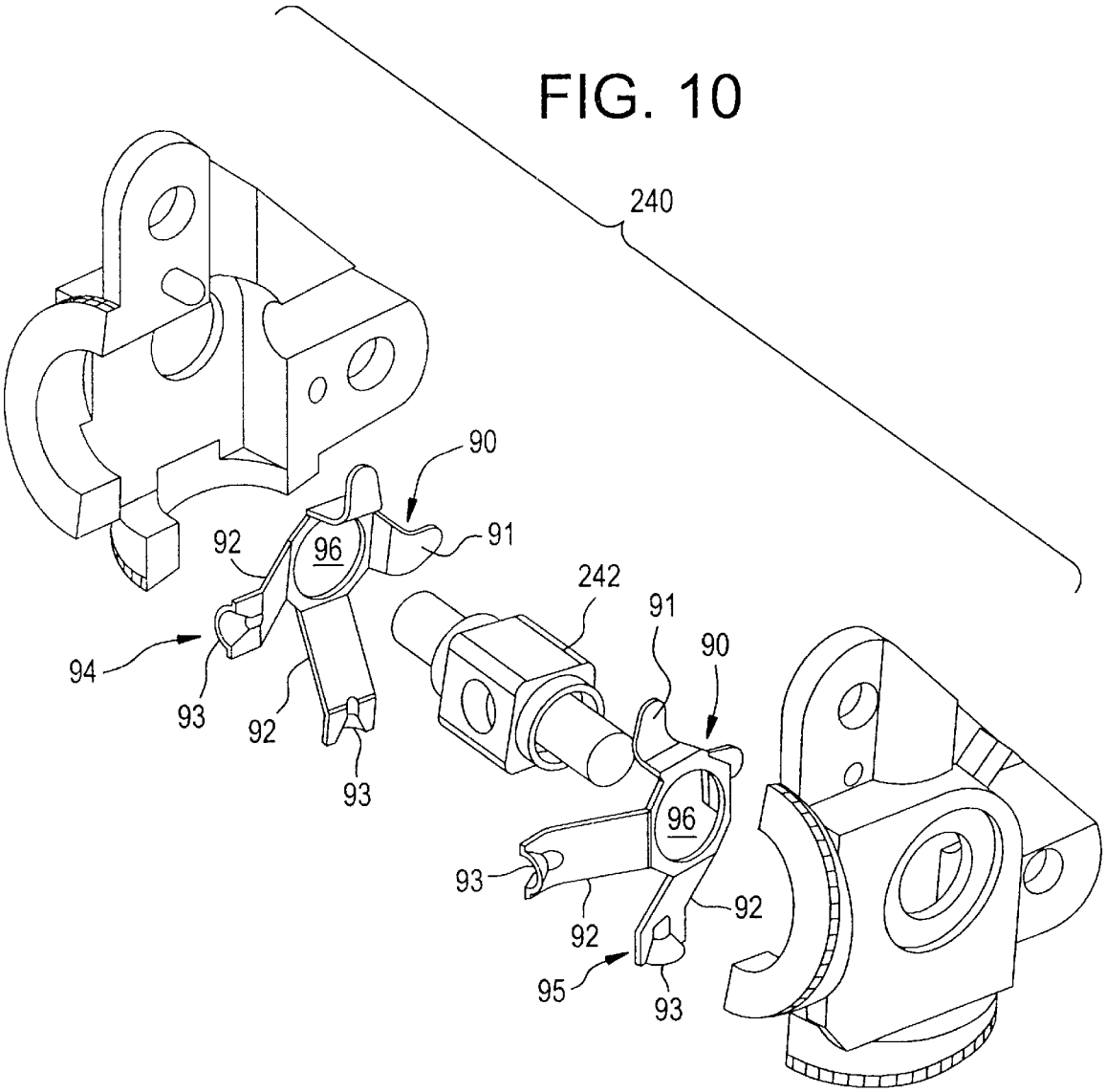
FIG. 10 is a perspective view of an unassembled alternative terminal housing.

The present invention can also be used with taps 15 that utilize retaining terminal housings 240 similar to that shown in FIG. 10. The retaining terminal housings 240 are similar to the above described terminal housings, but instead of using a terminal screw, the terminal contact 242 is in contact with retaining clasps 90 that maintain the conductors 52, 53 in position. The retaining clasps 90 are preferably formed by opposed collets 91 which include a plurality of receiving arms 92 which extend outwardly from central openings 96. The collets 91 are constructed of a flexible, electrically conductive material. The ends of arms 92 are molded into generally semi-circular shaped portions 93. The arms 92 are angled outward and away from the central openings 96. When the terminal housing 40 is riveted together, the arms 92 of the collets 90 are compressed by the inner walls of the housing cover to form expandable couplers 94, 95. The couplers 94 are generally aligned for receiving input and output conductors 52, 53 and the couplers 95 are aligned with the tap plug ports 27. Upon insertion of the signal-input and output conductors 52, 53, the couplers 94 are forced slightly apart as the arms 92 of the collets 90 separate to accommodate the conductors. The couplers 94 clamp the conductors to limit movement and provide a secure signal contact. When the jumper 160 is connected, the plungers 140 are moved into contact with the couplers 95 to bypass the tap 15.

While the present invention has been described in terms of the preferred embodiment, other variations which are within the scope of the invention as defined in the claims will be apparent to those skilled in the art.

I claim:

1. A tap plug adapted for attachment to a plug port which opens into a signal tap housing, the housing having a contact terminal positioned therein with a portion aligned with the plug port and a portion conductively interconnected with a conductor, the tap plug comprising:

a body having a generally open end and a head end, the head end having an aperture therethrough to the open end; and a plunger positioned in the body in alignment with the aperture and moveable between a non-contact position and a position where the plunger extends into conductive contact with the terminal contact.

2. The tap plug according to claim 1 further comprising a gland which covers the aperture.

3. The tap plug according to claim 2 wherein the gland is manufactured from a resilient material.

4. The tap plug according to claim 2 wherein the gland has a passage therethrough.

5. The tap plug according to claim 1 further comprising a biasing means which biases the plunger toward the non-contact position.

6. The tap plug according to claim 5 wherein the biasing means is a spring.

7. The tap plug according to claim 1 wherein the plunger is adapted to contact a terminal screw interconnected with the contact terminal.

8. The tap plug according to claim 1 wherein the plunger is adapted to contact a retaining clasp interconnected with the contact terminal.

9. The tap plug according to claim 1 wherein the body is hollow.

10. The tap plug according to claim 1 wherein the body is threaded.

11. The tap plug according to claim 1 wherein an insulator is provided in the body about the plunger.

12. The tap plug according to claim 1 wherein a first end of the plunger includes a detent adapted to receive a jumper pin.

13. The tap plug according to claim 1 wherein a portion of the plunger extends beyond the body open end as it moves toward the conductive position.

14. A kit for bypassing a tap which includes a pair of plug ports aligned with a pair of contact terminals that connect a pair of conductors to the tap, the kit comprising:

a pair of contact plugs adapted to be inserted into the plug ports, each plug including:

a body which is generally open at a first end and terminates in a head surface at a second end;

an aperture in the head surface; and a plunger positioned in the body in alignment with the aperture and moveable between a non-contact position and a position where the plunger extends into conductive contact with the terminal contact; and a jumper including at least two pins which are conductively interconnected and adapted to be aligned with the apertures whereby the pins are inserted into the apertures and move each plunger to its conductive position to allow a signal flowing through the tap to flow through the jumper.

15. The kit according to claim 14 wherein each contact plug further comprises a gland which covers its aperture.

16. The kit according to claim 15 wherein each gland is manufactured from a resilient material.

17. The kit according to claim 15 wherein each gland has a passage therethrough.

18. The kit according to claim 14 wherein each contact plug further comprises a biasing means which biases the plunger toward the non-contact position.

19. The kit according to claim 18 wherein each biasing means is a spring.

20. The kit according to claim 14 wherein each plunger is adapted to contact a terminal screw interconnected with its respective contact terminal.

21. The kit according to claim 14 wherein the plunger is adapted to contact a retaining clasp interconnected with its respective contact terminal.

22. The kit according to claim 14 wherein each contact plug body is hollow.

23. The kit according to claim 14 wherein each contact plug body is threaded.

24. The kit according to claim 14 wherein an insulator is provided in each contact plug body about the respective plunger.

25. The kit according to claim 14 wherein a first end of each plunger includes a detent adapted to receive one of the jumper pins.

26. The kit according to claim 14 wherein the jumper includes an insulated body.

27. The kit according to claim 26 wherein the jumper insulated body includes a pair of connection ports, each pin being aligned in a respective connection port.

28. The kit according to claim 27 wherein each connection port is adapted to receive one of the plug ports.

29. The kit according to claim 26 wherein each connection port includes a sealing ring.

30. The kit according to claim 14 wherein the jumper further includes an indicator means for indicating when a signal is properly flowing through the jumper.

31. The kit according to claim 30 wherein the indicator means is an LED indicator.

32. The kit according to claim 30 wherein the indicator means is adapted to provide a voltage reading.

33. A method of bypassing a tap which includes a pair of plug ports aligned with a pair of contact terminals that connect a pair of conductors to the tap, the method comprising the steps of:

providing a contact plug in each port which includes:

a body which is generally open at a first end and terminates in a head surface at a second end;

an aperture in the head surface; and a plunger positioned in the body in alignment with the aperture and moveable between a non-contact position and a position where the plunger is in conductive contact with the terminal contact; and engaging a jumper including at least two pins which are conductively interconnected and adapted to be aligned with the apertures with the tap whereby the pins enter the apertures and move each plunger to its conductive position to allow a signal flowing through the tap to flow through the jumper.

* * * * *